US007210377B2

(12) United States Patent
Griffo et al.

(10) Patent No.: US 7,210,377 B2
(45) Date of Patent: May 1, 2007

(54) CONE EROSION PROTECTION FOR ROLLER CONE DRILL BITS

(75) Inventors: Anthony Griffo, The Woodlands, TX (US); Zhigang Fang, The Woodlands, TX (US); Robert H. Slaughter, Jr., Ponca City, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/774,571

(22) Filed: Feb. 9, 2004

(65) Prior Publication Data

US 2004/0187290 A1 Sep. 30, 2004

Related U.S. Application Data

(62) Division of application No. 09/974,735, filed on Oct. 10, 2001, now Pat. No. 6,698,098.

(51) Int. Cl.
*B21K 5/04* (2006.01)

(52) U.S. Cl. ..... 76/108.2

(58) Field of Classification Search ..... 76/108.2, 76/108.1, 108.4, 108.6; 175/331, 341
See application file for complete search history.

(56) References Cited

U.S. PATENT DOCUMENTS 3,513,728 A * 5/1970 Hudson et al. ..... 76/108.1
4,679,640 A * 7/1987 Crawford ..... 76/108.2
4,889,017 A * 12/1989 Fuller et al. ..... 76/108.2
5,051,112 A * 9/1991 Keshavan et al. ..... 51/309
5,348,770 A * 9/1994 Sievers et al. ..... 175/374
6,454,030 B1 * 9/2002 Findley et al. ..... 76/108.2
6,568,491 B1 * 5/2003 Matthews et al. ..... 76/108.2
2002/0035895 A1 * 3/2002 Davies et al. ..... 76/108.2

* cited by examiner

*Primary Examiner*—Jason Prone
(74) *Attorney, Agent, or Firm*—Osha Liang LLP

(57) ABSTRACT

A method of forming a drill bit structure, the method including fixing spacers to the drill bit structure. The spacers are arranged at preselected locations on an outer surface of the drill bit structure. A hardfacing material is then applied to the drill bit structure, and the spacers are removed. Holes are machined in the drill bit structure at the preselected locations, and drilling inserts are positioned in each hole.

A method of forming a drill bit structure, the method including applying a hardfacing material to selected surfaces of the drill bit structure. The hardfacing material includes a perforated carbide infiltrated material and a perforated powder infiltrated material. The perforations in the powder infiltrated material correspond to the perforations in the carbide infiltrated material. Holes are machined in the drill bit structure at the locations of the perforations, and drilling inserts are positioned in each hole.

24 Claims, 7 Drawing Sheets

CONE EROSION PROTECTION FOR ROLLER CONE DRILL BITS

CROSS-REFERENCE TO RELATED APPLICATIONS

This application is a divisional application of U.S. patent application Ser. No. 09/974,735 entitled "CONE EROSION PROTECTION FOR ROLLER CONE BITS," filed Oct. 10, 2001 now U.S. Pat. No. 6,698,098.

BACKGROUND OF INVENTION

1. Field of the Invention

The invention relates generally drill bits used to drill wellbores through earth formations. More specifically, the invention relates to hardfacing structures applied to drill bits and methods for applying the same so as to reduce erosion of the drill bit during drilling operations.

2. Background Art

Drill bits used to drill wellbores through earth formations generally are made within one of two broad categories of bit structures. Drill bits in the first category are generally known as "fixed cutter" or "drag" bits, which usually include a bit body formed from steel or another high strength material and a plurality of cutting elements disposed at selected positions about the bit body. The cutting elements may be formed from any one or combination of hard or superhard materials, including, for example, natural or synthetic diamond, boron nitride, and tungsten carbide.

Drill bits of the second category are typically referred to as "roller cone" bits, which usually include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Application of hardfacing to the base material from which the cones and drill bit are formed is known in the art. The hardfacing can be applied in the form of special erosion protection inserts used in addition to the cutting elements. See for example, U.S. Pat. No. 3,952,815 issued to Dysart. Another method known in the art that uses hardfacing to protect roller cones is described in U.S. Pat. No. 5,291,807 issued to Dysart. The method in the Dysart '807 patent includes marking the face of a roller cone by masking or etching, applying hardfacing material, such as tungsten carbide, in the form of a powder, and heating the cone to bond the hardfacing powder to the cone. U.S. Pat. Nos. 3,461,983 and 3,513,728 issued to Hudson include disclosure related to drilling holes (sockets) in the cone prior to application of the hardfacing, plugging the holes, and then applying the hardfacing material using a flame application process. After applying the hardfacing material with the flame process, the plugs are removed and the inserts are pressed into the previously drilled sockets.

Moreover, U.S. Pat. No. 5,348,770 issued to Sievers discloses a method for applying hardfacing to a cone which uses a high velocity oxygen fuel (HVOF) spray process after the cone is formed. Forming the cone includes drilling the sockets for the inserts. U.S. Pat. No. 4,396,077 issued to Radtke discloses a method for applying hardfacing to a fixed cutter bit. The method includes generating an electric arc and spraying arc-heated hardfacing material onto a substantially completely assembled bit structure.

SUMMARY OF INVENTION

In one aspect, the invention comprises a method of forming a drill bit structure, the method comprising affixing a plurality of spacers to the drill bit structure at preselected locations on an outer surface of the drill bit structure. A hardfacing material is applied to the drill bit structure. The plurality of spacers are then removed from the drill bit structure and holes are machined in the drill bit structure proximate the preselected locations. Drilling inserts are positioned in each hole.

In another aspect, the invention comprises a method of forming a drill bit structure, the method comprising machining a plurality of holes at preselected locations in the drill bit structure. Spacer inserts are positioned in each of the plurality of holes. A hardfacing material is applied to the drill bit structure using an arc hardfacing process, and the plurality of spacer inserts are removed from the plurality of holes. Drilling inserts are positioned in each of the plurality of holes.

In another aspect, the invention comprises a method of forming a drill bit structure, the method comprising machining a plurality of holes in preselected locations in the drill bit structure. Spacer insert are positioned in each of the plurality of holes. A hardfacing material is applied to the drill bit structure using an arc hardfacing process, and the plurality of spacer inserts are removed from the plurality of holes. The plurality of machined holes are enlarged to a selected diameter so as to enable disposition of drilling inserts therein, and drilling inserts are positioned in each of the plurality of enlarged holes.

In another aspect, the invention comprises a method of forming a drill bit structure, the method comprising machining a plurality of holes in preselected locations in the drill bit structure. Spacer insert are positioned in each of the plurality of holes. A hardfacing material is applied to the drill bit structure using a high velocity oxygen fuel hardfacing process, and the plurality of spacer inserts are removed from the plurality of holes. The plurality of machined holes are enlarged to a selected diameter so as to enable disposition of drilling inserts therein, and drilling inserts are positioned in each of the plurality of enlarged holes.

In another aspect, the invention comprises a method of forming a drill bit structure, the method comprising machining a plurality of holes at preselected locations in the drill bit structure. Spacer inserts are positioned in each of the plurality of holes. A hardfacing material is applied to the drill bit structure with a high velocity oxygen fuel hardfacing process, and the plurality of spacer inserts are removed from the plurality of holes. Drilling inserts are positioned in each of the plurality of holes.

In another aspect, the invention comprises a method of forming a drill bit structure, the method comprising applying a hardfacing material to selected surfaces of the drill bit structure. The hardfacing material comprises a carbide infiltrated material comprising a plurality of perforations at preselected locations therein and a powder infiltrated material comprising a plurality of perforations therein, the perforations in the powder infiltrated material adapted to correspond to the perforations in the carbide infiltrated material.

A plurality of holes are machined in the drill bit structure proximate the plurality of corresponding perforations, and drilling inserts are positioned in each hole.

Other aspects and advantages of the invention will be apparent from the following description and the appended claims.

DETAILED DESCRIPTION

Figure 1:
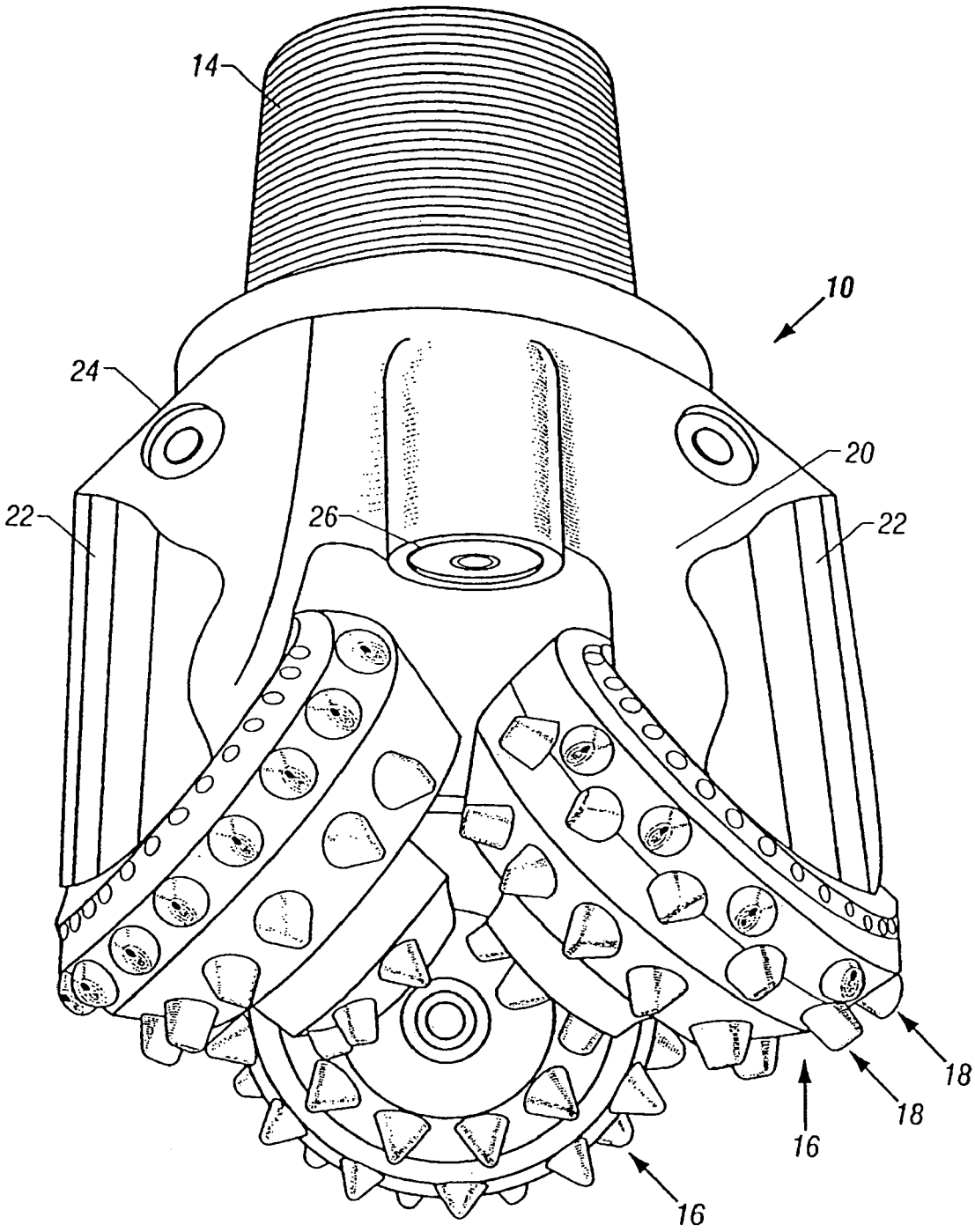
FIG. 1 (Prior Art)
FIG. 1 shows a typical prior art roller cone drill bit.

FIG. 1 shows a typical prior art roller cone bit used for drilling boreholes in earth formations. The drill bit 10 comprises a bit body 20 and threads 14 formed at an upper end and three legs 22 formed at a lower end. The threads 14 are adapted to couple the bit 10 to a drillstring or bottom hole assembly (BHA) (not shown) used to drill a wellbore (not shown).

Each of three roller cones 16 is rotatably mounted on a corresponding leg 22 proximate the lower end of the bit body 20. A plurality of cutting elements, which in this case comprise inserts 18 that are typically formed from cemented tungsten carbide, are press-fit (or interference fit), brazed, or otherwise affixed in holes (not shown separately in FIG. 1) formed in the roller cones 16. Lubricant for the roller cones 16 is provided to the journals (19 in FIG. 2) on which the roller cones 16 are rotatably mounted from grease reservoirs 24 in the bit body 20. This configuration is generally used for sealed-bearing rock bits. For open-bearing (unsealed) rock bits, such as those typically used in mining applications, there typically are no grease reservoirs 24.

Figure 2:
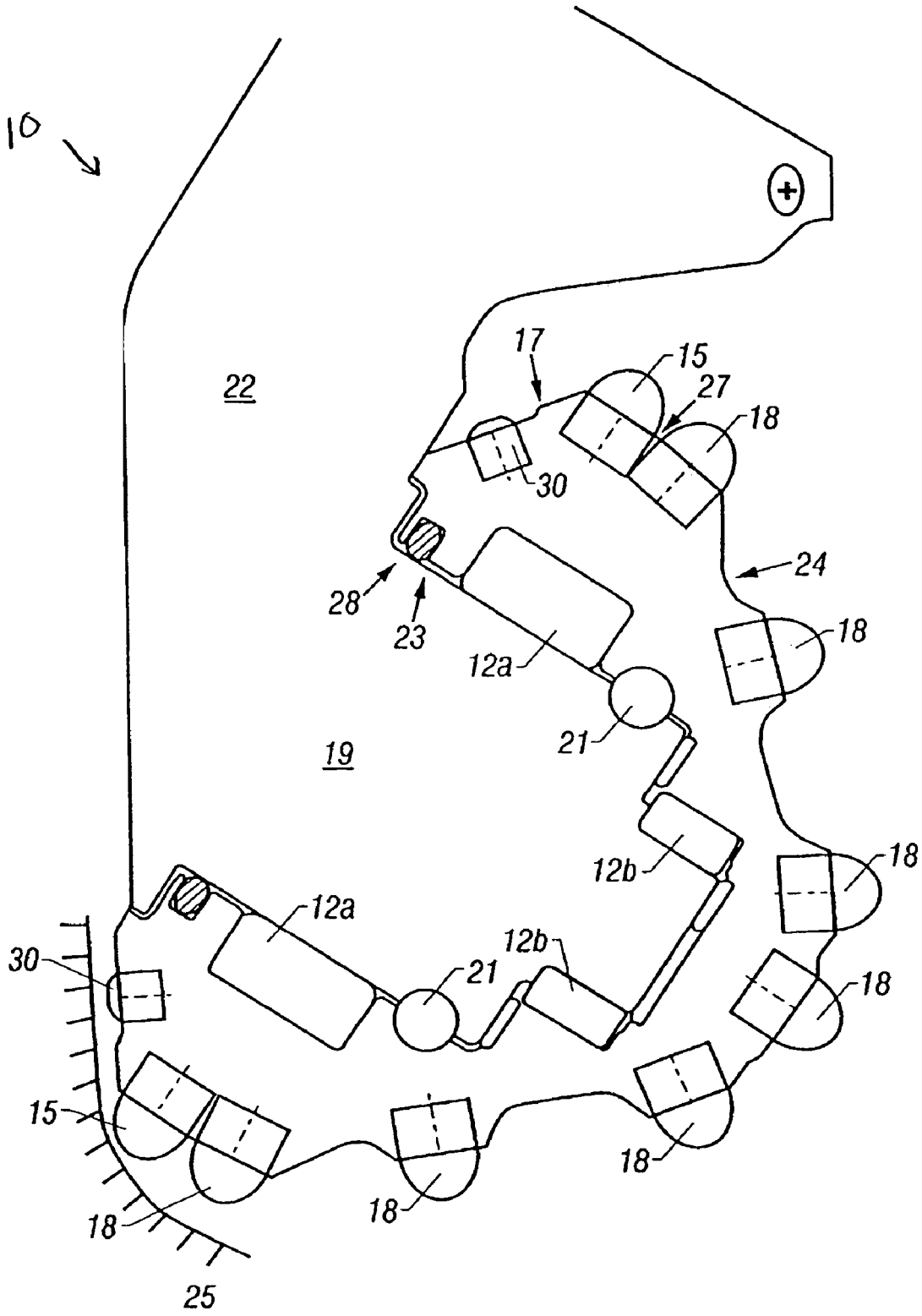
FIG. 2 (Prior Art)
FIG. 2 shows a cross-sectional view of a leg of the roller cone drill bit of FIG. 1.

Referring to FIG. 2, when in use, the drill bit 10 is threaded onto a lower end of the drillstring (not shown) and lowered into a wellbore or borehole. The drillstring is rotated by, for example, a rig rotary table (not shown) or a top drive (not shown), and the inserts 18 in the cones 16 engage the bottom and side of the borehole 25. As the bit rotates, the cones 16 rotate on the bearing journals 19 and drill the borehole 25. Weight on bit (WOB) is applied to the drillstring and to the formation by the inserts 18, and the formation is generally crushed and chipped (or scraped) by the inserts 18. A drilling fluid (often referred to as "drilling mud") is usually pumped through the drillstring to the drill bit (10 in FIG. 1) and is ejected through nozzles (26 in FIG. 1) disposed in the bit body (20 in FIG. 1). The drilling fluid then travels up a borehole annulus (not shown) formed between the exterior of the drillstring and the borehole 25 wall. The drilling fluid transports most of the formation cuttings drilled by the bit to the surface. In addition, the drilling fluid serves to cool and clean the inserts 18 and roller cones 16 as the borehole 25 is being drilled.

FIG. 2 also shows a lower portion of the leg 22 that supports a journal bearing 19. A plurality of cone retention balls 21 (e.g., "locking balls") and roller bearings 12*a* and 12*b* surround the journal 19. An O-ring 28, located within in an O-ring groove 23, seals the bearing assembly. The type of seal and roller cone retention device are only shown here to illustrate the general structure of a roller cone drill bit and are not intended to limit the invention.

The cones 16 include multiple rows of the inserts 18, and the roller cones 16 generally include a heel portion 17 located between gage row inserts 15 and the O-ring groove 23. A plurality of heel row inserts 30 are approximately equally spaced about a circumference of the heel 17. The heel row inserts 30 and the gage row inserts 15 act together to drill a gage diameter of the borehole 25. The interior row inserts 18 are generally arranged in, for example, concentric rows, and they serve to crush and chip the earth formations being drilled.

As used herein, the term "erosion" refers to both erosion and other abrasive wear. Much of the erosion of the roller cones 16 typically occurs between the gage row inserts 15 and heel row inserts 30. Furthermore, erosion also may occur at lands 27 formed between the gage row inserts 15 and inner row inserts 18. Generally, a "land" refers to a surface on a roller cone where holes (e.g., "sockets") are drilled so that inserts 18, 15, 30 may be disposed therein. Moreover, erosion may occur in grooves 24 formed between successive inner rows of inserts 18. These areas on a roller cone surface are collectively referred to as "areas susceptible to erosion" and must generally be protected to increase the longevity of the drill bit in both normal and harsh drilling conditions. For example, erosion in these areas may result in damage to the roller cone, loss of the inserts and/or roller cone cracking (particularly between the inserts), and/or a loss of lubrication for the roller cones. In highly erosive environments, the entire cone body may be exposed to severe erosion.

Accordingly, embodiments of the present invention relate to methods of applying hardfacing coatings to roller cones and drill bits so that bit longevity and performance may be extended, especially in harsh drilling conditions. In some embodiments of the invention, hardfacing coatings may be applied with an arc process as described in U.S. Pat. No. 6,196,338 issued to Slaughter et al. and assigned to the assignee of the present invention. For example, the hardfacing may be applied with a plasma transferred arc process (PTA), a gas-shielding tungsten arc (also known as "gas tungsten arc") welding process, a metal inert gas arc ("gas metal arc") welding process, and similar processes known in the art.

In some embodiments, an electric arc such as that formed by the PTA process is preferred because an area of a cone heated for application of hardfacing may be closely controlled. Advantageously, close control of the heated area prevents damage to a large area of the cone that may be produced with, for example, an unshielded chemical flame.

The following detailed discussion describes various aspects of the invention. The hardfacing techniques described below may be used to apply a hardfacing coating to any drill bit structure such as, for example, a roller cone or a drill bit shoulder. Accordingly, descriptions related to application of hardfacing coatings to roller cones are not intended to limit the scope of the invention to a single use (e.g., hardfacing roller cones). Further, while some embodiments are described with respect to insertion of cutting elements into machined holes in a drill bit structure, other types of drilling inserts (where the term drilling inserts is intended to include cutting elements), such as gage protection elements, may be used within the scope of the invention. Accordingly, the examples provided in the description below are not intended to be limiting with respect to, for example, a specific type of drilling insert.

Figure 3A:
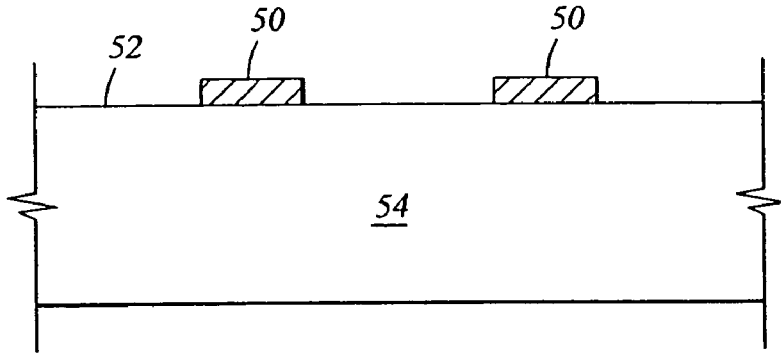
FIG. 3A shows a cross-sectional view of spacers affixed to a surface of a drill bit structure in accordance with an embodiment of the invention.

In one embodiment of the invention shown in FIG. 3A, spacers 50 are disposed on a surface 52 of a roller cone 54 that is rotatably attached to a drill bit (not shown) in a manner similar to that described above. The spacers 50 may comprise, for example, graphite, oxide ceramics (including porous alumina, porous silica, mullite, and the like), soft metals (including copper and the like), and other suitable materials known in the art. Moreover, coated metals, metallized plastic, heat resistant plastic, and the like may also be used with embodiments of the invention.

The spacers 50 may be positioned at selected locations on the surface 52 of the roller cone 54. The positioning of the spacers 50 is adapted to correspond to, for example, desired locations of cutting element inserts that will be affixed to the roller cone 50 after a hardfacing material has been applied thereto. The spacers 50 enable a hardfacing material to be applied to the entire surface 52 of the roller cone 54 without, for example, omitting hardfacing from the desired locations where cutting element inserts (or drilling inserts) and/or gage protection elements are to be disposed. This aspect of the invention helps ensure that a substantially even coating of hardfacing material is applied to the selected areas of the roller cone 54 and/or drill bit (not shown). Moreover, use of spacers 50 may increase a speed of application of the hardfacing material because an operator does not have to spend as much time avoiding application of the hardfacing material to the locations where cutting element inserts will be disposed.

Figure 3B:
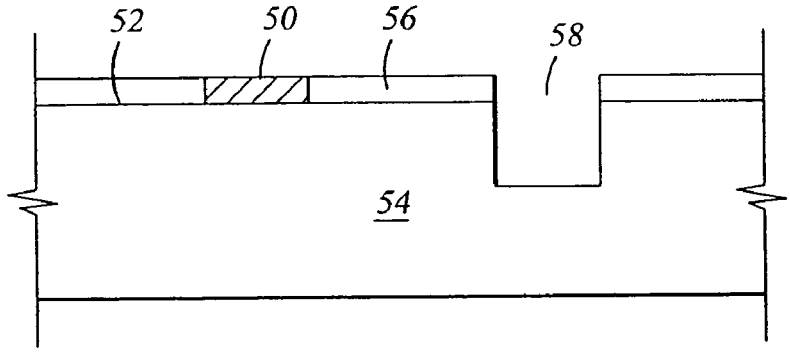
FIG. 3B shows a cross-sectional view of a hardfaced drill bit structure in accordance with an embodiment of the invention.

Referring to FIG. 3B, the spacers 50 may be affixed (e.g., adhesively or mechanically bonded) to the surface 52 of the roller cone 54 in selected locations, the selected locations forming, for example, a number of rows (not shown). Hardfacing material 56 may then be applied to the surface 52 of the roller cone 54 so that the spacers 50 remain substantially exposed (as shown in FIG. 3B). After the hardfacing material 56 has been applied, the spacers 50 may be removed by any means known in the art (e.g., by breaking, chipping, and/or drilling out the spacers) so that holes adapted to receive cutting element inserts, gage protections inserts, and the like may be drilled (e.g., machined) in the non-hardfaced portions of the roller cone (formerly occupied by the spacers). Note that, in other embodiments, the spacers may be substantially covered with hardfacing material during the coating process.

After hardfacing has been completed, and because the hardfacing material 56 generally does not adhere to the spacers in the same manner as the hardfacing material 56 adheres to a base metal of the roller cone 54 (e.g., because the hardfacing material 56 generally does not form a metallurgical or mechanical bond with the spacers 50), the portions of the hardfacing material 56 proximate the spacers 50 may be removed so that cutting element insert holes 58 my be drilled as described above. After the holes 58 have been drilled in the roller cone 54, cutting element inserts (not shown) may be affixed in the holes 58 by interference fit, brazing, and/or other means known in the art.

Figure 3C:
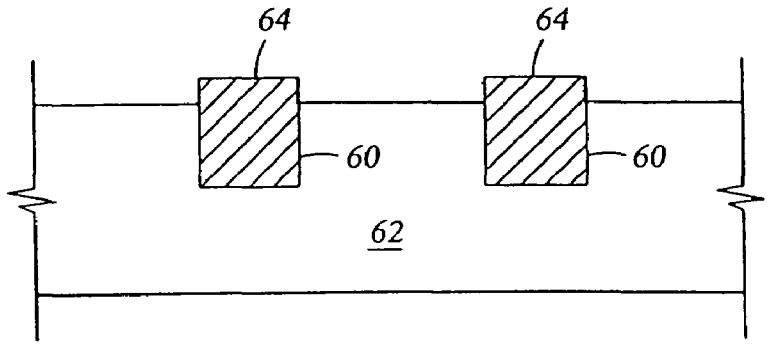
FIG. 3C shows a cross-sectional view of spacer inserts positioned in holes machined in a drill bit structure in accordance with an embodiment of the invention.

In another embodiment of the invention shown in FIG. 3C, cutting element insert holes 60 may be drilled in a roller cone 62 prior to hardfacing. Spacer inserts 64, such as graphite inserts, may then be inserted into the holes 60. Note that materials other than graphite may be used in various embodiments of the invention, including the materials described above with respect to spacers. For example, the spacer inserts 64 may comprise oxide ceramics (including porous alumina, porous silica, mullite, and the like), soft metals (including copper and the like), and other suitable materials known in the art. Moreover, coated metals, metallized plastic, heat resistant plastic, and the like may also be used.

Figure 3D:
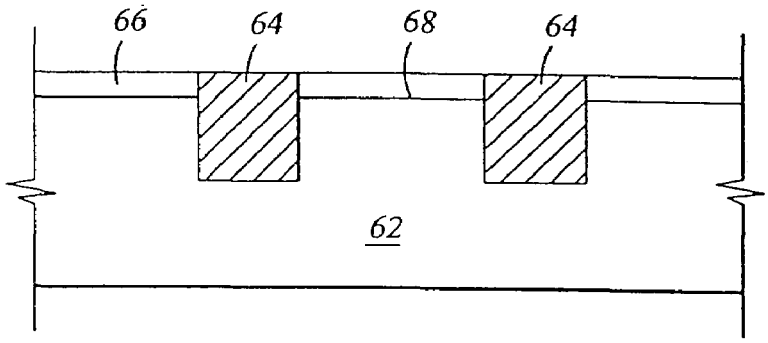
FIG. 3D shows a cross-sectional view of a hardfaced drill bit structure in accordance with an embodiment of the invention.
Figure 3E:
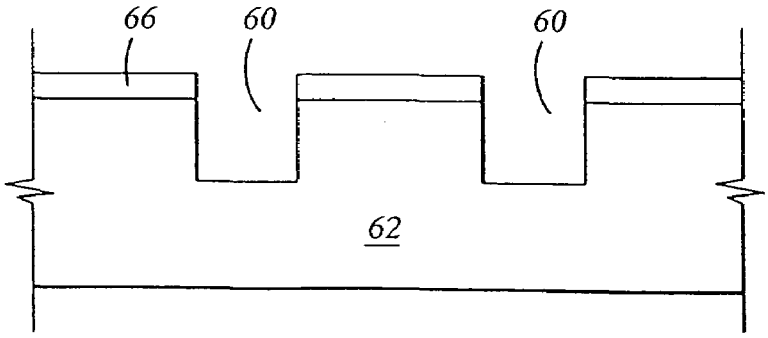
FIG. 3E shows a cross-sectional view of a hardfaced drill bit structure in accordance with an embodiment of the invention.

Referring to FIG. 3D, hardfacing material 66 may then be applied to a surface 68 of the roller cone 62 and/or other selected portions of the drill bit (not shown), and the inserts 64 may be either substantially exposed or substantially covered after application of the hardfacing material 66 (as in the embodiments described above). As shown in FIG. 3E, the inserts 64 may be removed from the roller cone 62 after hardfacing material 66 has been applied thereto so that cutting element inserts (not shown) may be affixed in the holes 60 by brazing and/or other means known in the art.

Figure 3F:
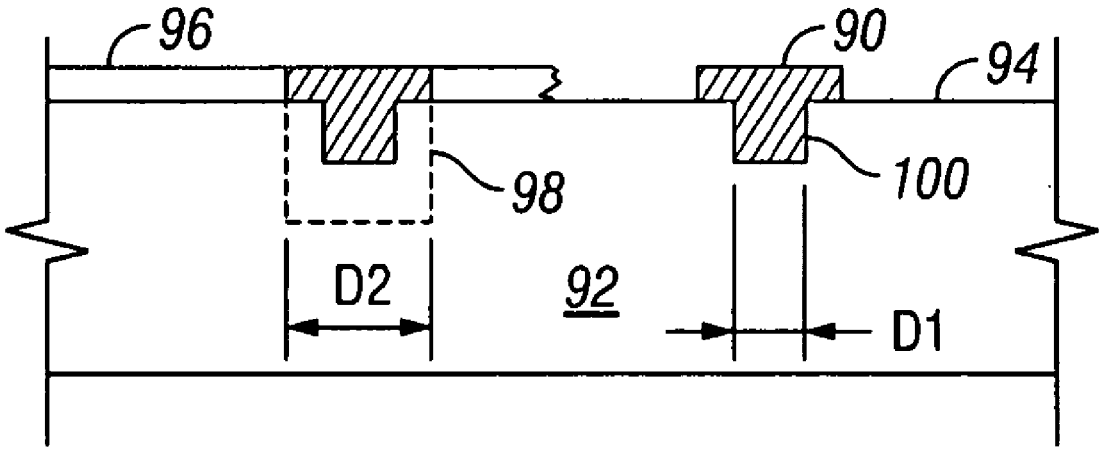
FIG. 3F shows a cross-sectional view of an embodiment of the invention.

In another embodiment of the invention shown in FIG. 3F, holes 100 having a diameter D1 may be machined in a roller cone 92 prior to hardfacing. Spacer inserts typically referred to as "mushroom caps" 90 may be inserted into the holes 100. Hardfacing material 96 may then be applied to a surface 94 of the roller cone 92 and/or other selected portions of the drill bit (not shown), and the mushroom caps 90 may be either substantially exposed or substantially covered after application of the hardfacing material 96 (as in the embodiments described above). The mushroom caps 90 may be removed from the roller cone 92 after hardfacing material 96 has been applied thereto. After removal of the mushroom caps 90, the holes 100 may be enlarged to a diameter D2 so as to form cutting element insert holes 98 (shown as the dashed line in FIG. 3F) so that cutting element inserts (not shown) may be affixed in the insert holes 98 by brazing and/or other means known in the art. In this manner, the mushroom caps 90 act as both spacers and spacer inserts and enable an insert hole 98 to be enlarged to the desired diameter D2 after hardfacing material 96 has been applied to the roller cone 92.

The mushroom caps 90 may be formed from any suitable material known in the art. For example, the mushroom caps 90 may be formed from the materials described above with respect to the spacers and spacer inserts of the previous embodiments.

The previous embodiments related to the use of, for example, inserts as spacers for the positioning of cutting element inserts generally include application of hardfacing materials using the aforementioned arc processes. Moreover, high velocity oxygen fuel (HVOF) processes may also be used to apply hardfacing in these embodiments of the invention. In a preferred embodiment, the hardfacing material is applied via an electric arc process. The electric arc process enables the hardfacing material application to be closely controlled so that, for example, only selected portions of the roller cone and/or drill bit to be hardfaced are heated to elevated temperatures during the hardfacing process.

Advantageously, the above described embodiments of the invention include precise application of a selected pattern of hardfacing material to the roller cone or other surface that is to be coated for erosion protection. In this manner, the invention helps avoid formation of a hardened layer that is difficult to machine when, for example, cutting element inserts holes are later drilled for installation of cutting element inserts.

Figure 4A:
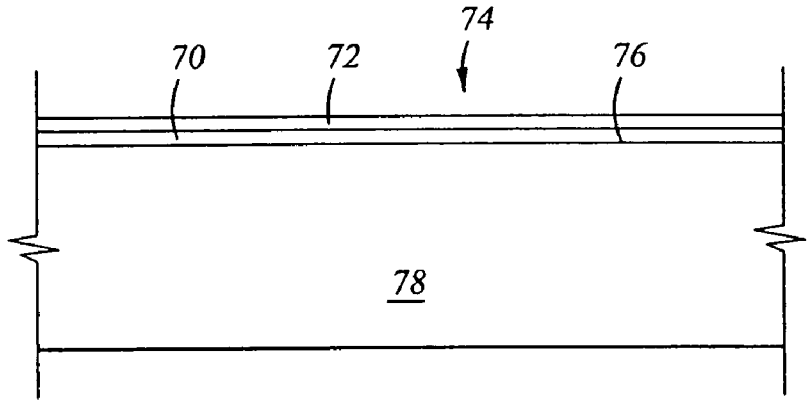
FIG. 4A shows a cross-sectional view of an embodiment of the invention.

In another embodiment of the invention shown in FIG. 4A, layers 70, 72 of infiltrated material are used to form a coating of hardfacing material 74 over a surface 76 of, for example, a roller cone 78. The layers 70, 72 of infiltrated material may comprise, for example, tungsten carbide infiltrated materials sold under the name "Conforma Clad," a mark of Conforma Clad, Inc., of New Albany, Ind. Application of the hardfacing material 74 includes, for example, positioning a carbide infiltrated layer 70 over the surface 76 of the roller cone 78. Note that as used herein the term "infiltrated material" represents a discrete layer of bonded material that may be easily handled and, for example, placed over a surface to be hardfaced in a substantially conformal manner. Typically, in the embodiments described herein, polytetrafluoroethylene (PTFE, which may be, for example, a material sold under the name "Teflon," a mark of E. I. DuPont de Nemours of Wilmington, Del.) forms a structural component such as a cloth, and is later "burned off" or vaporized during the hardfacing process. Accordingly, the carbide infiltrated layer 70 may comprise, for example, tungsten carbide and PTFE.

Figure 4B:
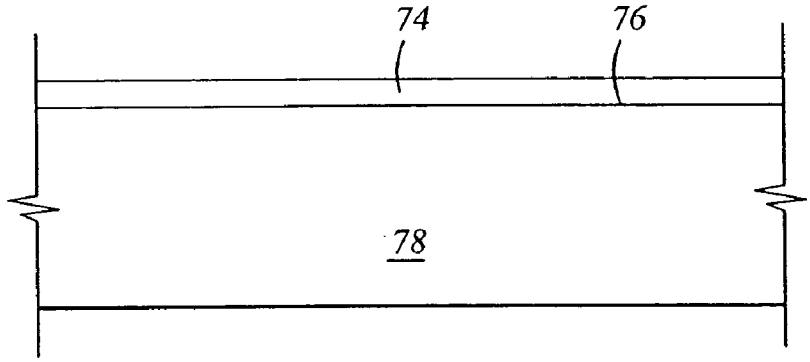
FIG. 4B shows a cross-sectional view of an embodiment of the invention.

A powder infiltrated layer 72 may then be placed on top of the carbide infiltrated layer 70. The powder infiltrated layer 72 may comprise, for example, Nickel, Boron, Cobalt, Silicon, Chromium, PTFE, and combinations thereof. The roller cone 78, the carbide infiltrated layer 70, and the powder infiltrated layer 72 are then heated in a controlled environment (e.g., in an enclosed oven (not shown) with a selectively controlled atmosphere) to a relatively low temperature so as to vaporize the PTFE. The temperature is then elevated to approximately 900–1200° C. for a selected period of time. At the elevated temperature, the alloys (e.g., Nickel, Cobalt, etc.) in the powder infiltrated layer 72 liquefy, infiltrate the carbide infiltrated layer 70, and thereby form a hardfacing material 74 that becomes metallurgically bonded to the surface 76 of the roller cone 78 (see, e.g., FIG. 4B). The composition of the infiltrated layers 70, 72 may be varied so that the hardfacing material 74 is adapted for use in specific environments. Such compositions are known in the art, and the materials listed above in the simplified description of the invention are not intended to limit the invention to a specific composition.

Heating of the infiltrated layers 70, 72 may be performed by any means known in the art. For example, the roller cone 78 and/or other parts of the drill bit (including the entire bit in some embodiments) may be placed in an oven and heated to the selected temperatures. In other embodiments, heating may be performed using spot heating sources including lasers, high intensity light sources, induction heating tools, microwave sources, and the like. Accordingly, the type of heat source used to heat the infiltrated layers 70, 72 so as to form the desired metallurgical bond is not intended to be limiting.

Figure 4C:
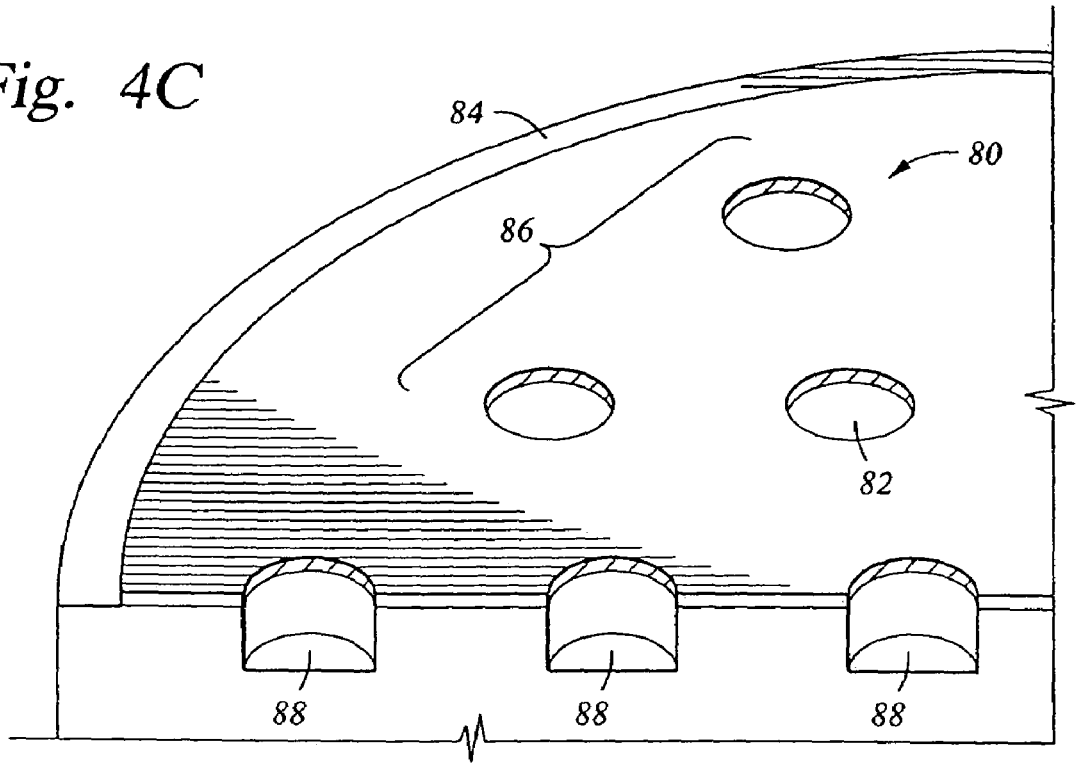
FIG. 4C shows a perspective view of an embodiment of the invention.

In embodiment shown in FIG. 4C, the infiltrated layers 80 typically comprise perforations 82 in selected corresponding locations (e.g., perforations formed in the carbide infiltrated layer are adapted so as to align with perforations formed in the powder infiltrated material) so as to allow for later disposition of cutting element inserts in a roller cone 84. For example, the infiltrated layers 80 may be perforated in a selected manner so as to form "rows" 86 of perforations 82 when the infiltrated layers 80 are disposed on the roller cone 84, a gage surface (not shown), or any other part of a drill bit (not shown) that is to be coated with a hardfacing material. In this manner, the roller cone 84 may be hardfaced while selected areas of the roller cone 84 proximate the perforations 82 may remain substantially uncoated so that cutting element holes 88 may be machined in the roller cone 84 surface so as to allow for disposition (e.g., brazing) of cutting element inserts therein.

In another embodiment of the invention, the infiltrated layers are selectively infiltrated with hardfacing materials so that selected areas of the infiltrated layers comprise substantially only PTFE (or another suitable material) that may be vaporized at a relatively low temperature. After the PTFE (or other suitable material) is vaporized, "gaps" or preformed perforations are formed in the hardfacing material. The gaps are selectively arranged to correspond to desired locations of insert holes (e.g., in rows) that may be machined in a roller cone or other drill bit structure after the hardfacing process has been completed. Accordingly, specially formed infiltrated layers may be developed to correspond to, for example, selected roller cone cutting element geometries, different size roller cones (e.g., for different sizes of drill bits), and the like.

Note that other embodiments may comprise, for example, a carbide infiltrated layer pre-bonded to a powder infiltrated layer (e.g., using a mechanical bond, an adhesive bond, a chemical bond, or similar means known in the art). In these embodiments, perforations in the materials may be pre-aligned so as to ease positioning the materials proximate the surface of the drill bit structure in a desired manner.

Advantageously, the infiltrated material hardfacing process forms a strong metallurgical bond with, for example, the surface of the roller cone. The metallurgical bond is typically stronger (e.g., more resistant to wear and erosion) than a traditional mechanical bond formed by other hardfacing processes. The metallurgical bond provides increased wear resistance and longevity when drilling in, for example, harsh downhole and/or other subsurface environments. Further, the perforations in the infiltrated materials may be closely controlled so as to produce, for example, a closely toleranced cutting element arrangement. Finally, application of the infiltrated cloth to the hardfaced areas may be performed relatively quickly (as compared to, for example, traditional welded application hardfacing processes).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method of forming a drill bit structure, the method comprising:

machining a plurality of holes in preselected locations in the drill bit structure;

positioning a spacer insert in each of the plurality of holes;

applying a hardfacing material over at least a portion of an outer surface of the drill bit structure;

removing the plurality of spacer inserts from the plurality of holes;

enlarging the entire diameter of each of the plurality of machined holes to a substantially uniform selected diameter so as to enable disposition of drilling inserts therein; and positioning drilling inserts in each of the plurality of enlarged holes.

2. The method of claim 1, wherein applying the hardfacing material comprises using a high velocity oxygen fuel hardfacing process.

3. The method of claim 2, wherein the drill bit structure comprises at least one roller cone.

4. The method of claim 3, wherein the plurality of holes are machined in substantially circumferential rows on the at least one roller cone.

5. The method of claim 2, wherein the drill bit structure comprises at least one shoulder of a bit body.

6. The method of claim 5, further comprising arranging the plurality of spacer inserts in rows on the at least one shoulder.

7. The method of claim 2, wherein the spacer inserts comprise graphite.

8. The method of claim 2, wherein the spacer inserts comprise oxide ceramic.

9. The method of claim 2, wherein the spacer inserts comprise soft metal.

10. The method of claim 2, wherein the spacer inserts comprise heat resistant plastic.

11. The method of claim 2, wherein the affixing comprises adhesively bonding the plurality spacer inserts to the drill bit structure.

12. The method of claim 2, wherein the positioning drilling inserts comprises brazing drilling inserts in each hole.

13. The method of claim 1, wherein applying the hardfacing material comprises using an arc hardfacing process.

14. The method of claim 13, wherein the drill bit structure comprises at least one roller cone.

15. The method of claim 14, wherein the plurality of holes are machined in substantially circumferential rows on the at least one roller cone.

16. The method of claim 13, wherein the drill bit structure comprises at least one shoulder of a bit body.

17. The method of claim 16, further comprising arranging the plurality of spacers inserts in rows on the at least one shoulder.

18. The method of claim 13, wherein the spacer inserts comprise graphite.

19. The method of claim 13, wherein the spacer inserts comprise oxide ceramic.

20. The method of claim 13, wherein the spacer inserts comprise soft metal.

21. The method of claim 13, wherein the spacer inserts comprise heat resistant plastic.

22. The method of claim 13, wherein the affixing comprises adhesively bonding the plurality spacer inserts to the drill bit structure.

23. The method of claim 13, wherein the positioning drilling inserts comprises brazing drilling inserts in each hole.

24. The method of claim 1, wherein at least a portion of the spacer insert is covered after application of the hardfacing material.

* * * * *